US010458203B2

(12) United States Patent
Mailand et al.

(10) Patent No.: US 10,458,203 B2
(45) Date of Patent: Oct. 29, 2019

(54) PRESSURE CYCLE ACTUATED INJECTION VALVE

(71) Applicant: Tejas Research & Engineering, LLC, The Woodlands, TX (US)

(72) Inventors: Jason C. Mailand, The Woodlands, TX (US); Thomas G. Hill, Jr., The Woodlands, TX (US)

(73) Assignee: Tejas Research & Engineering, LLC, The Woodlands, TX (US)

( * ) Notice: Subject to any disclaimer, the term of this patent is extended or adjusted under 35 U.S.C. 154(b) by 47 days.

(21) Appl. No.: 15/483,313

(22) Filed: Apr. 10, 2017

(65) Prior Publication Data

US 2017/0292347 A1 Oct. 12, 2017

Related U.S. Application Data

(60) Provisional application No. 62/321,557, filed on Apr. 12, 2016.

(51) Int. Cl.

| | |
|---|---|
| ***E21B 34/08*** | (2006.01) |
| ***E21B 34/10*** | (2006.01) |
| ***E21B 34/14*** | (2006.01) |
| *E21B 34/00* | (2006.01) |

(52) U.S. Cl.

CPC ..... *E21B 34/10* (2013.01); *E21B 34/08* (2013.01); *E21B 34/102* (2013.01); *E21B 34/14* (2013.01); *E21B 2034/005* (2013.01)

(58) Field of Classification Search

CPC ..... E21B 34/08; E21B 34/10; E21B 34/102; E21B 34/12; E21B 2034/005

See application file for complete search history.

(56) References Cited

U.S. PATENT DOCUMENTS

| | | | | |
|---|---|---|---|---|
| 3,205,955 | A * | 9/1965 | Whittle | E21B 4/02 137/515 |
| 7,614,452 | B2 | 11/2009 | Kenison | |
| 7,712,537 | B2 | 7/2010 | Hill et al. | |
| 2008/0236842 | A1 * | 10/2008 | Bhavsar | E21B 41/02 166/381 |
| 2012/0006553 | A1 | 1/2012 | Korkmaz | |
| 2014/0102703 | A1 | 4/2014 | Mailand et al. | |
| 2014/0246207 | A1 | 9/2014 | Hofman et al. | |
| 2015/0252640 | A1 | 10/2015 | Mailand et al. | |
| 2015/0337625 | A1 | 11/2015 | Mailand et al. | |
| 2015/0361763 | A1 | 12/2015 | Mailand et al. | |

OTHER PUBLICATIONS

International Search Report and Written Opinion for PCT/US2017/027023 dated Aug. 22, 2017.

* cited by examiner

*Primary Examiner* — Cathleen R Hutchins
(74) *Attorney, Agent, or Firm* — Basil M. Angelo

(57) ABSTRACT

A method and apparatus for completing a well that includes a subsurface barrier valve utilizes an injection valve which includes a variable orifice insert. The injection valve includes a mechanism for sensing pressure cycles that are employed during various well completion operations including pressure testing. The mechanism includes an indexing sleeve which will disable pressure functionality. Once this occurs, pressure cycling to open the barrier valve can proceed. Once the barrier valve opens, flow alone controls the injection valve during normal operations.

9 Claims, 17 Drawing Sheets

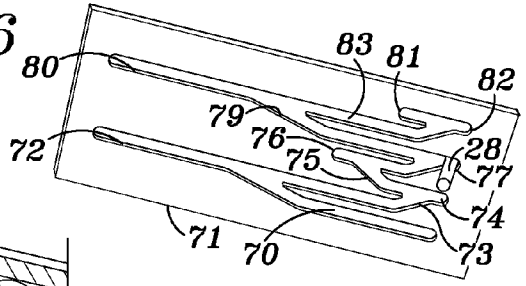
FIG. 26
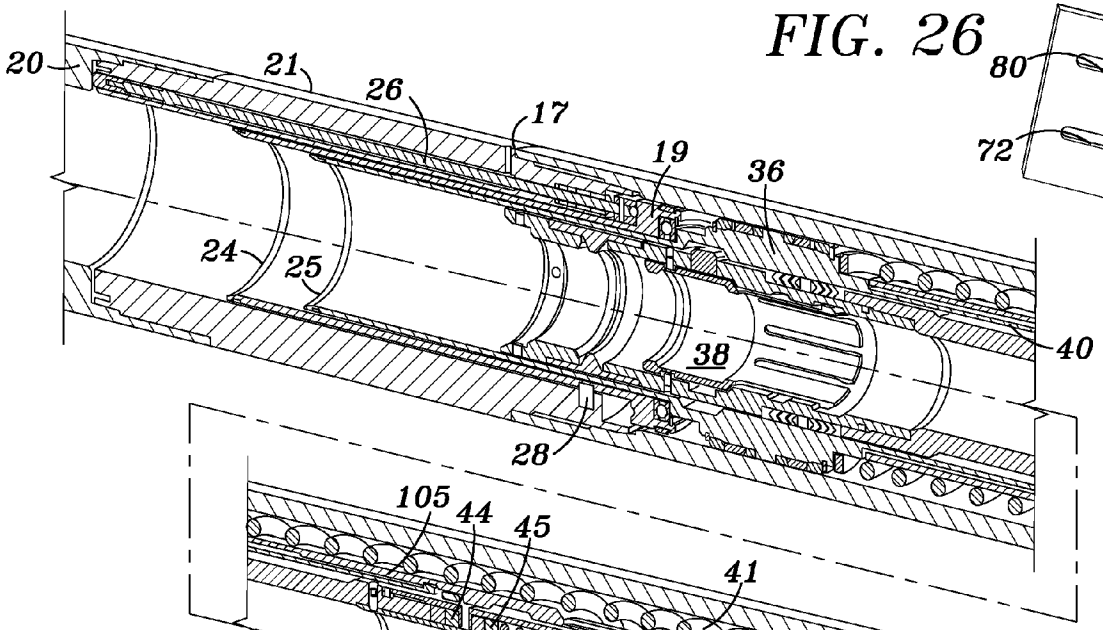
FIG. 25
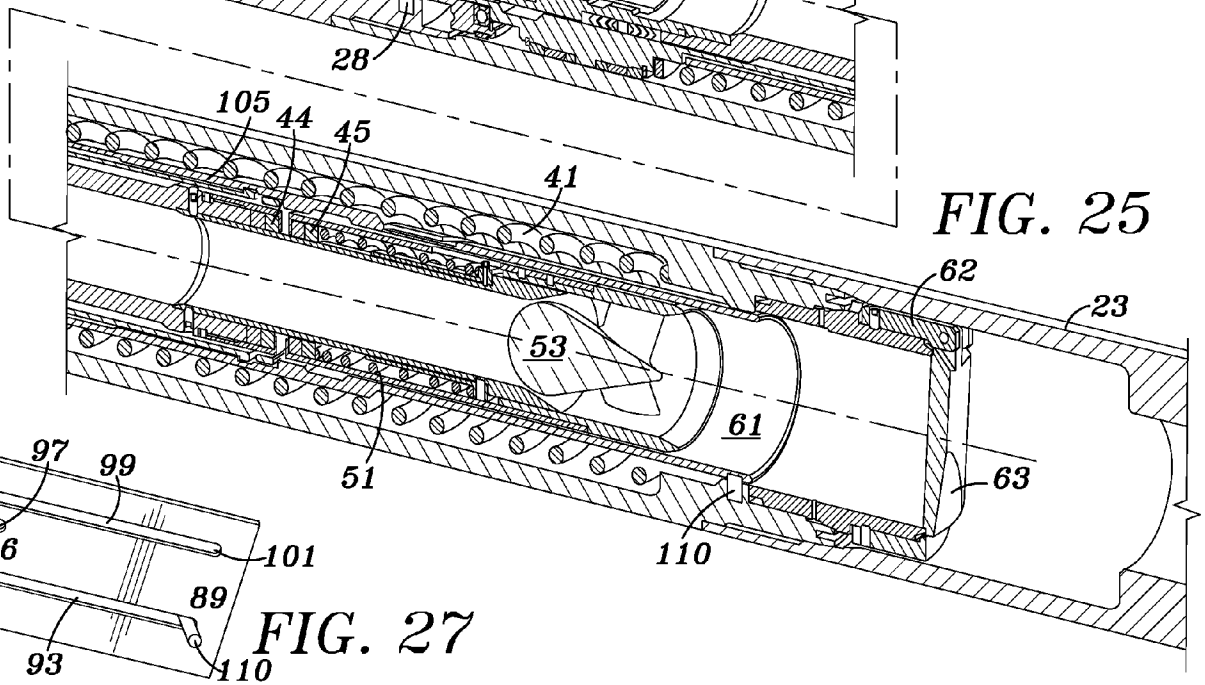
FIG. 27
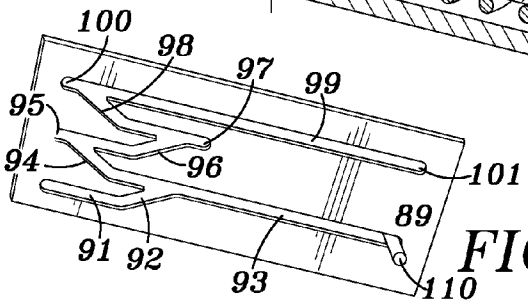

PRESSURE CYCLE ACTUATED INJECTION VALVE

CROSS-REFERENCE TO RELATED APPLICATIONS

This application claims priority to provisional U.S. patent application Ser. No. 62/321,557 filed Apr. 12, 2016, the entire contents of which is hereby expressly incorporated by reference thereto.

BACKGROUND OF THE INVENTION

Field of the Invention

This invention relates to a dual barrier pressure cycle actuated injection valve (DBPCAIV) that is used as a substitute for gas charged, deep set surface controlled subsurface safety valves currently in use for providing a safety valve in conjunction with a barrier valve in subsea oil/gas wells.

The DBPCAIV is positioned adjacent a stab at the end of a tubular string for providing a flow passage in the subsea well. The DBPCAIV is designed to accommodate a plurality of pressure cycles to facilitate testing at a pressure downhole gage (PDG).

BRIEF SUMMARY OF THE INVENTION

The DBPCAIV of the present invention includes an injection valve having a flapper closure valve at its downhole end and also includes a variable orifice insert.

The DBPCAIV together with a traditional barrier valve provide a dual barrier during installation.

Tubing pressure cycles close the valve and enable pressure testing at a pressure downhole gage. One or more additional pressure cycles reopen the injection valve and lock out its internal hydraulic piston. With pressure functionality disabled within the injection valve, pressure cycling that is required to open the barrier valve can proceed. When the barrier valve is opened, flow alone operates the safety valve during normal operation.

The injection valve includes an upper indexing sleeve that includes a plurality of groove segments on its outer surface. A pin fixed in the injection valve housing will cause the indexing sleeve to rotate in response to pressure cycles.

After a given number of pressure cycles the pin will constrain the axial movement of the indexing sleeve which in turn will lock out movement of a piston which is adapted to move a flow tube.

The injection valve also includes a lower indexing sleeve which also includes a plurality of groove segments that interact with a stationary pin to rotate the lower indexing sleeve through a plurality of pressure cycles. Once the barrier valve is open, the lower indexing sleeve is axially movable to an amount sufficient to open and close the flapper valve element during flow cycles of the injection fluid.

BRIEF DESCRIPTION OF SEVERAL VIEWS OF THE DRAWINGS

For a detailed description of the preferred embodiments of the invention, reference will now be made to the accompanying drawings in which:

FIG. 25 is a cross-sectional view of the injection valve after the tubing pressure is bleed to test for pressure leak rate between the injection valve and the barrier valve.

FIG. 26 is a showing of the pin in the grooves of the upper indexing sleeve when the injection valve is in the condition shown in FIG. 25.

FIG. 27 is a showing of the pin in the groove of the lower indexing sleeve when the injection valve is in the condition shown in FIG. 25.

DETAILED DESCRIPTION OF THE INVENTION

FIG. 1-5 illustrates the various steps that can be taken prior to opening the barrier valve of a subsea well according to an embodiment of the invention.

Figure 1:
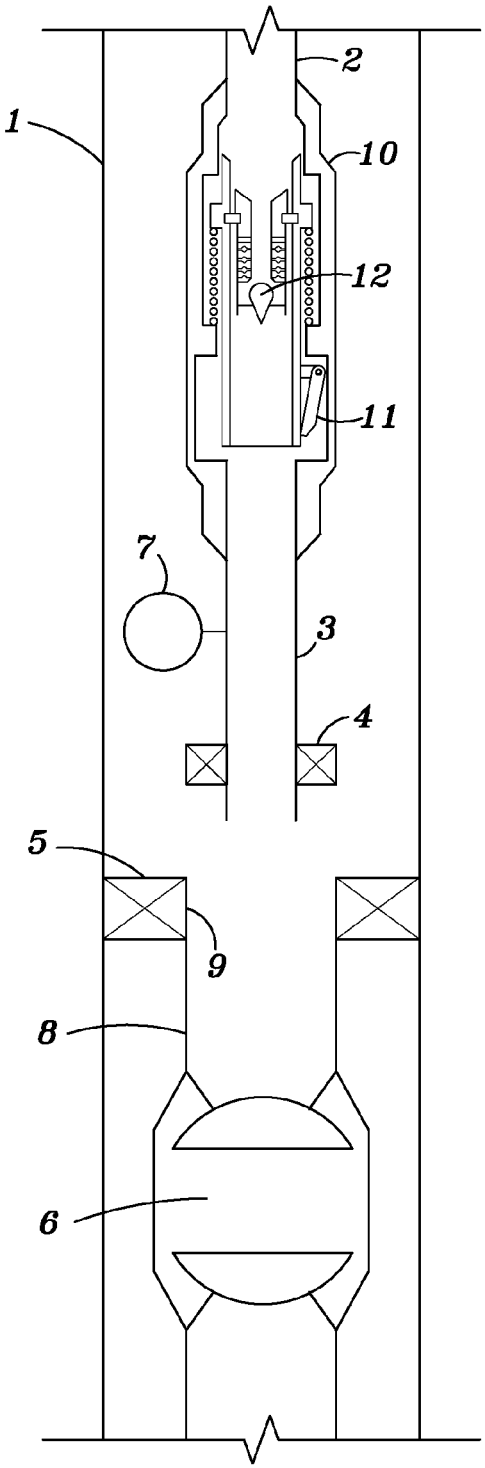
FIG. 1 is a schematic view of an injection valve according to an embodiment of the invention positioned adjacent to the polished bore receptacle of the well.

As shown in FIG. 1, a typical subsea well includes casing 1, a tubular string 2, a stab 3 with an annular seal 4, a polished bore receptacle 8, tubing hangers 5 and a barrier valve 6. In accordance with the invention an injection valve 10 with a variable orifice insert 12 is attached to a lower end of the tubular string 2. Injection valve 10 includes a flapper closure element 11. The flapper element 11 is in an open position and variable orifice insert 12 is in a bypass mode to allow the injection valve to be run into the well adjacent to the polished bore receptacle as shown in FIG. 1.

Figure 2:
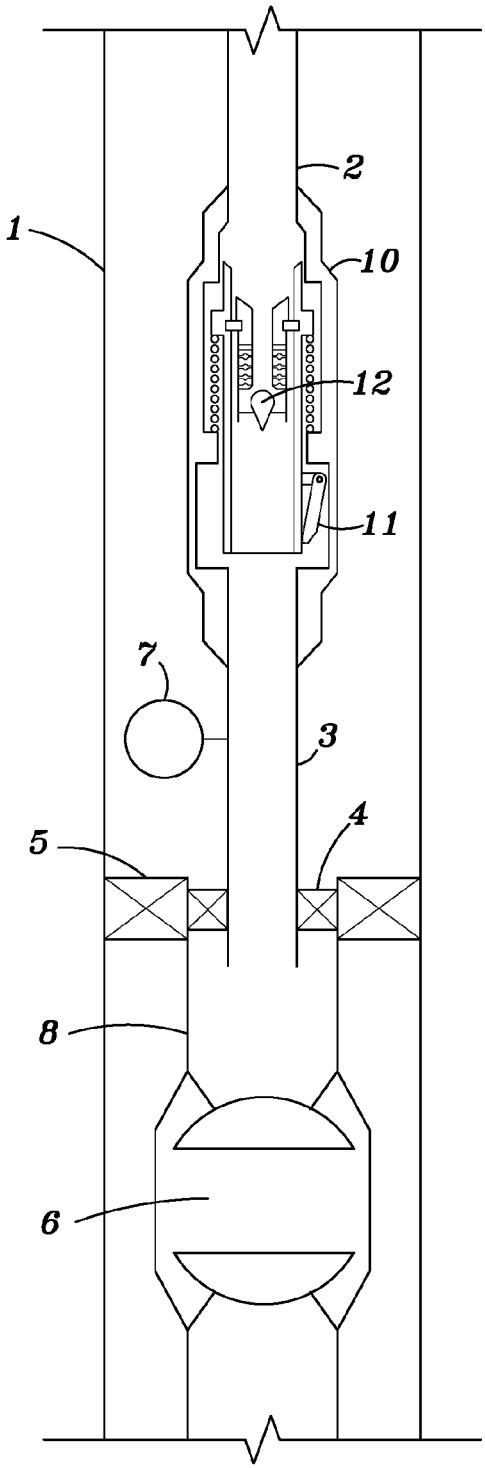
FIG. 2 is a schematic of the injection valve and tubing positioned within the polished bore receptacle.

FIG. 2 illustrates the position of the injection valve with stab 3 positioned within the polished bore receptacle. Flapper element 11 is in the open position and the variable orifice insert 12 is in the bypass mode.

Figure 3:
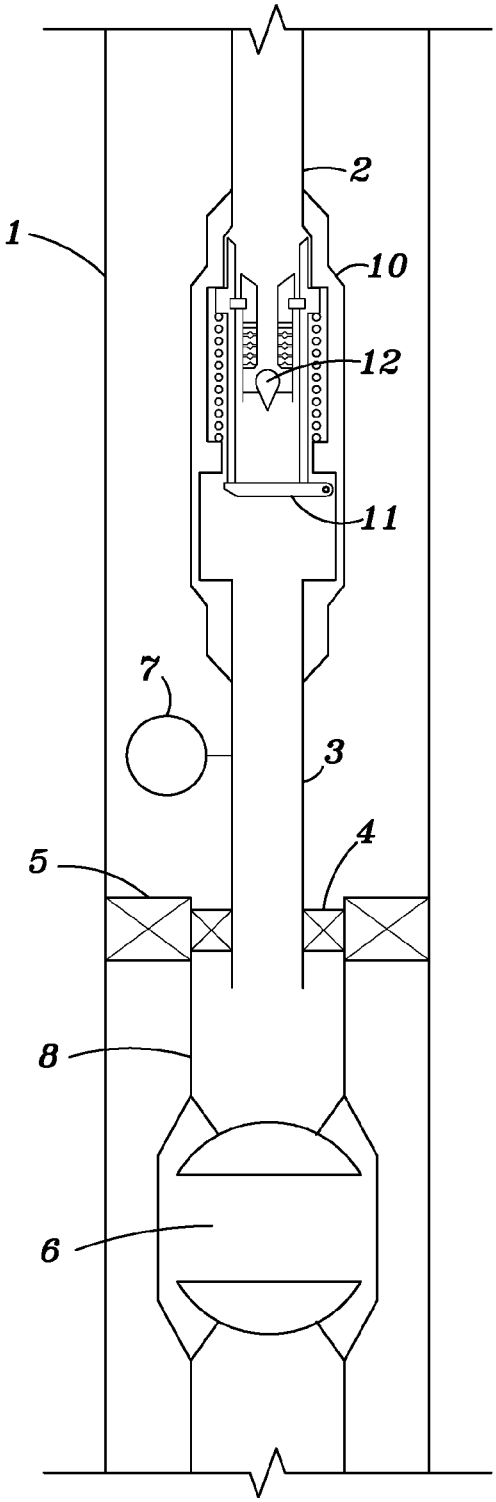
FIG. 3 is schematic of the injection valve with the flapper element in a closed position with the stab sealed in the polished bore receptacle.

Applying pressure to the barrier valve with the injection valve in the position and the relieving the tubing pressure will cause flapper element 11 to close as illustrated in FIG. 3 as discussed below. In order to pressure test the injection valve and barrier valve pressure now can be increase between the two valves via the pressure testing gauge and inlet 7, and pressure within tubing 2 is relieved. Once the dual barrier integrity is confirmed, the blowout preventer assembly can now be removed from the well head. At this point two pressure cycles have been completed.

Figure 4:
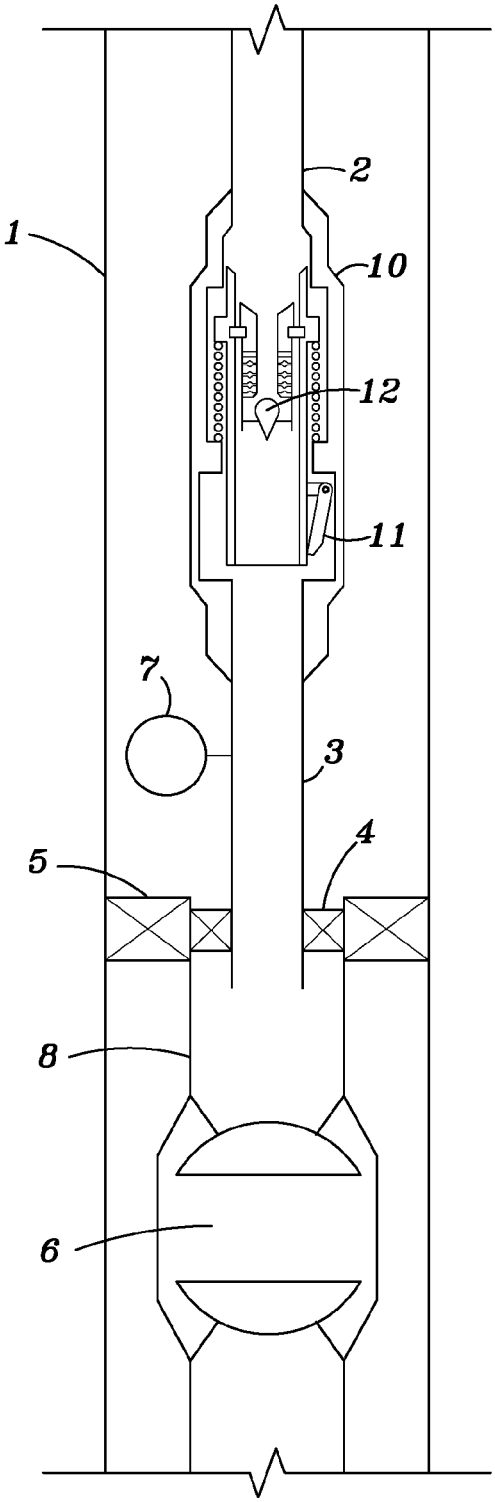
FIG. 4 is a schematic view of the injection valve in an open position with the stab sealed in the polished bore receptacle.

At this point by increasing tubing pressure the flapper element with open to the position shown in FIG. 4 and when tubing pressure is relieved, the flapper element will remain open as explained below. The variable orifice insert remains open in a bypass position. Now the barrier valve can be pressure cycled as needed with the injection valve and the variable orifice valve remaining open.

Figure 5:
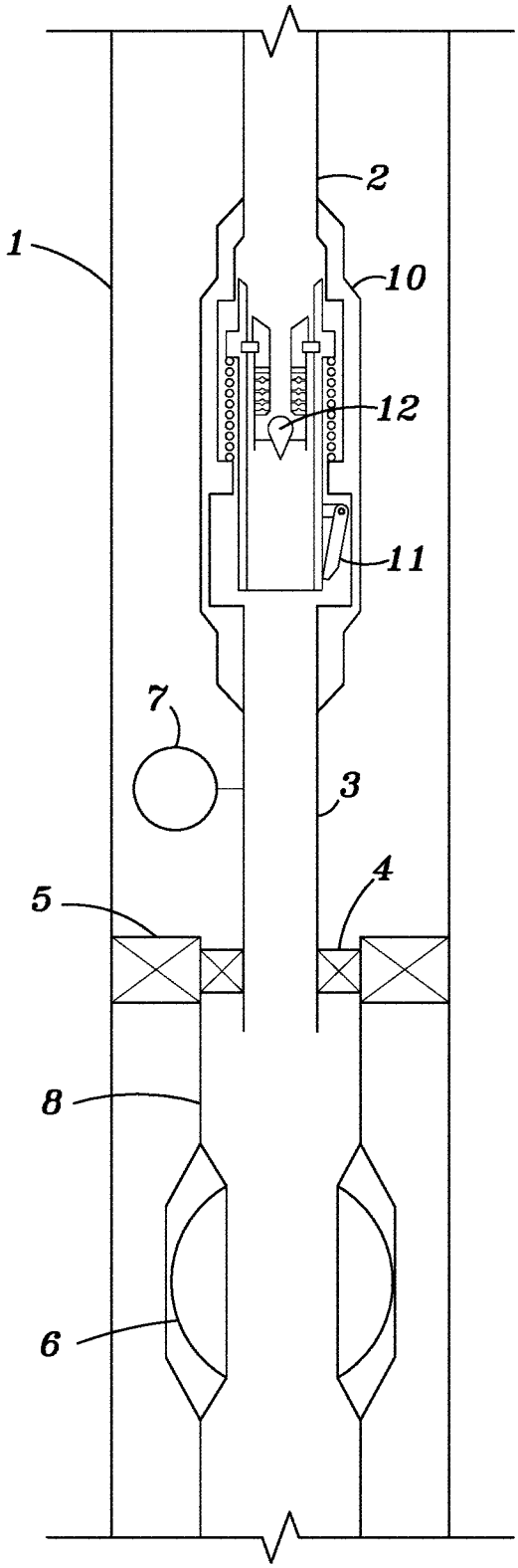
FIG. 5 is a schematic view of the injection valve in the open position and the barrier valve in an open position after the final barrier valve pressure cycle.
Figure 6:
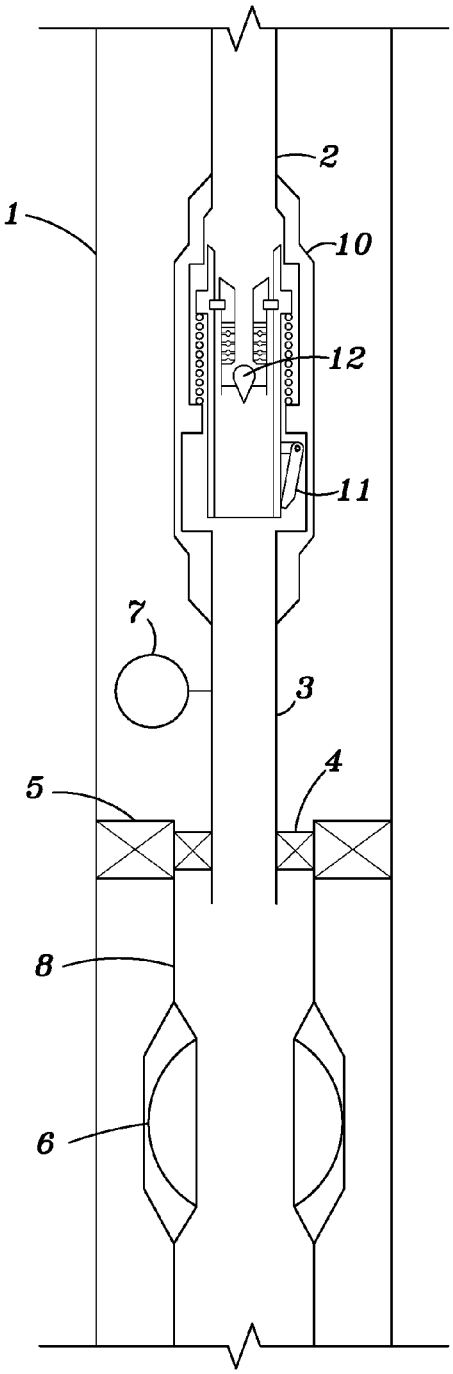
FIG. 6 is a schematic view of the injection valve and barrier valve in the open position during injection fluid flow.
Figure 7:
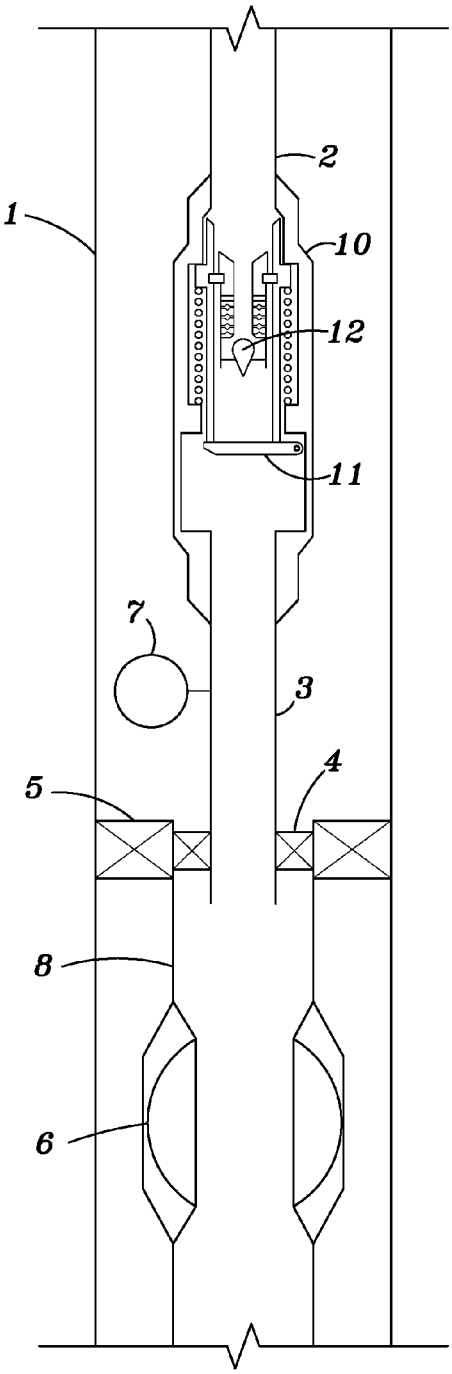
FIG. 7 is schematic view of the injection valve in a closed position when injection fluid flow is terminated.

FIG. 5 illustrates the barrier valve in an open position after the final barrier valve pressure cycle. With the barrier valve open initial injection flow resets the variable orifice insert as explained below and flow occurs through the barrier valve as shown in FIG. 6. When injection fluid flow stops, flapper element 11 will move to a closed position shown in FIG. 7. The variable orifice insert and the injection valve will open without flapper damage and close for protection when injection stops thereby forming a dual barrier injection valve.

Figure 8:
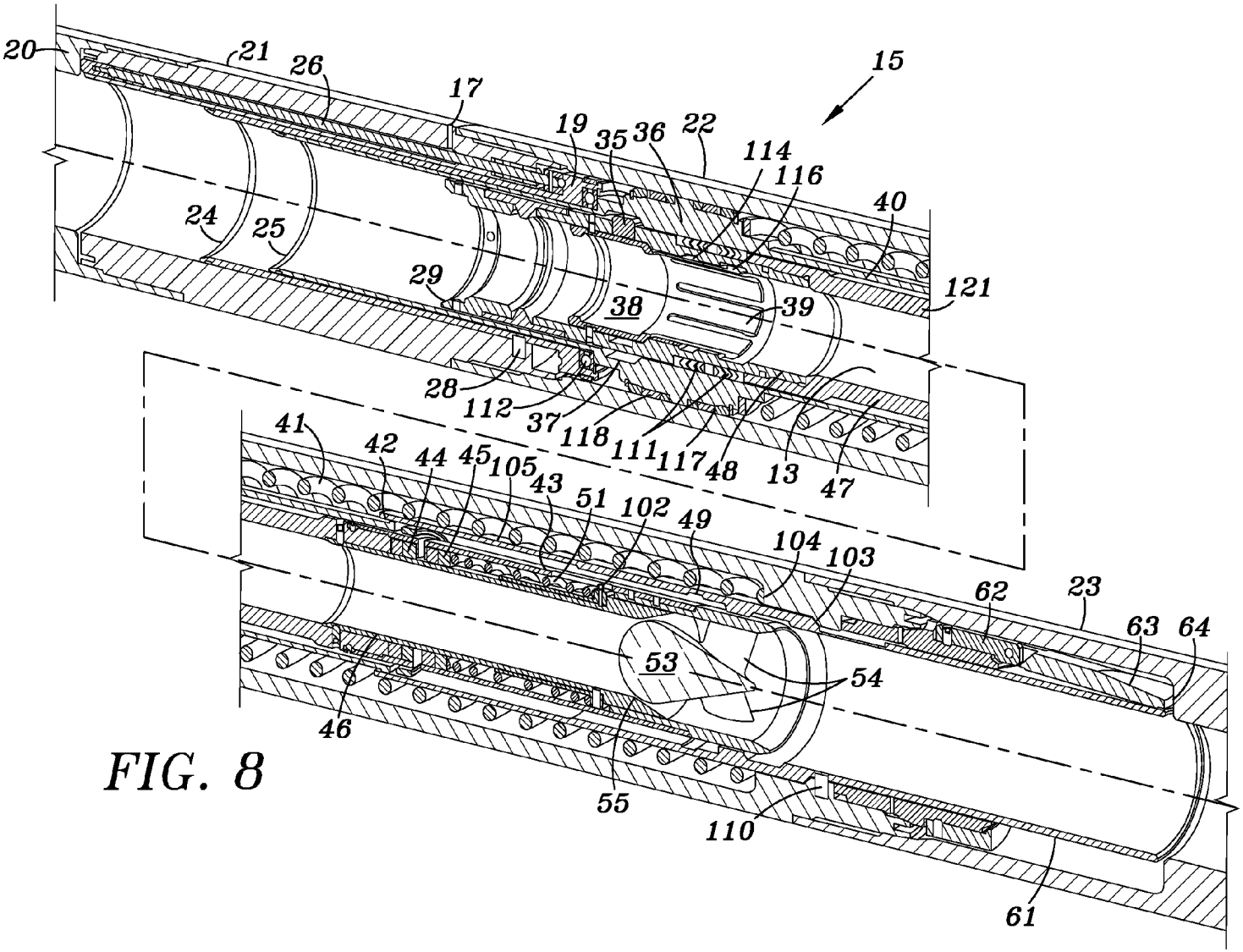
FIG. 8 is a cross-sectional view of the injection valve according to an embodiment of the invention.

FIG. 8 illustrates the details of an injector valve including a variable orifice insert according to an embodiment of the invention.

Injector valve 15 includes a main valve housing which includes an uphole connector portion 20, a piston housing 21 having a vent 17, a middle portion 22 and a downhole flapper element housing 23. Flapper element 63 is pivotably mounted by a pivot mount 62 to housing 23 in a known manner.

Figure 9:
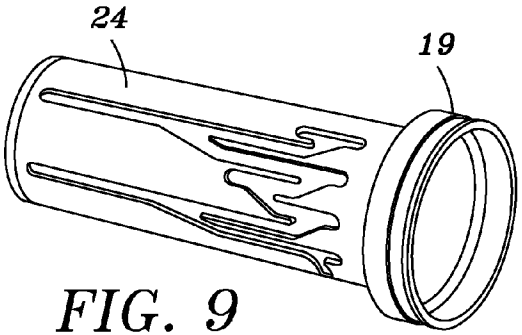
FIG. 9 is a perception view of the upper indexing sleeve.
Figure 10:
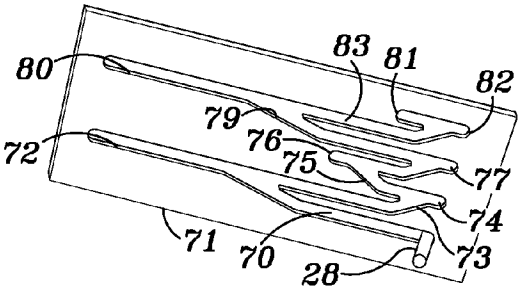
FIG. 10 is a schematic depiction of the grooves located on the surface of the upper indexing sleeve.

An hydraulic piston 26 is positioned within a wall section of piston housing 21. The uphole portion of piston 26 is exposed to pressure within connector portion 20. The downhole portion of piston 26 abuts against a shoulder 19 on an upper indexing sleeve 24. An upper flow tube 36 has an uphole portion 25 positioned within upper indexing sleeve 24, and a lower portion 40 which extends within middle hosing portion 22. Upper flow tube 36 also includes an enlarged portion 125. Upper indexing sleeve 24 shown in FIG. 9 is mounted for axial and rotational movement within the injection valve housing and includes a plurality of grooves section 70-83 as depicted in FIG. 10. A pin 28 fixed in housing 21 is adapted to guide axial and rotational movement of the upper indexing sleeve 24 via groove sections 70-83. An annular bearing 112 is positioned between shoulder 19 and upper flow tube 36.

A variable orifice insert 112 is inserted into the injection vale housing and includes a connector portion 29, a locking collet 38 with a plurality of radially spaced fingers 39 and an upper flow section 47 which is connected to a lower flow tube 46. At least one magnet 44 is attached to lower flow tube 46 and at least one magnet 45 of opposite polarity is freely mounted on the lower flow tube. Magnet 45 is adapted to move with a lower flow sleeve 43 which moves axially over lower flow tube 46. A spring 51 is positioned between magnet 45 and a stop 102 provided on lower flow tube 46 so that axial movement of lower flow sleeve 43 will compress spring 51. Seals 111 are positioned between upper flow tube 36 and the variable orifice insert 112.

Lower flow sleeve 43 carries at its downhole end a valve body 53 supported by a plurality of struts 54. A valve seat 55 is provided on the downhole end of lower flow tube 46 to create a variable annular orifice 115 shown in FIG. 40.

Figure 11:
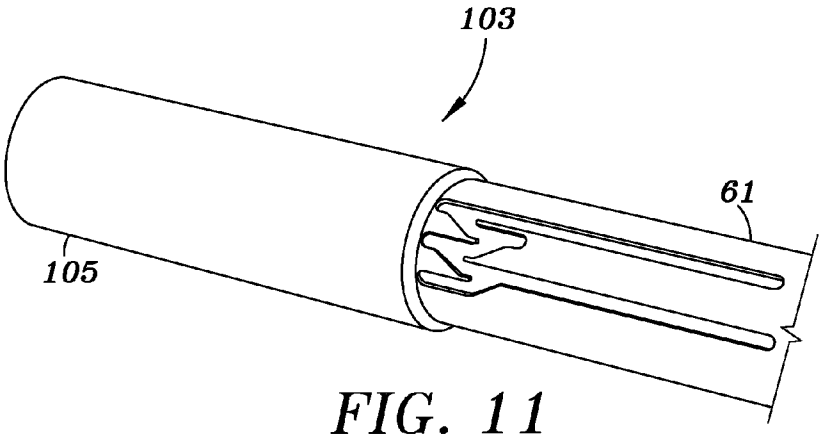
FIG. 11 is a perspective view of the lower indexing sleeve.
Figure 12:
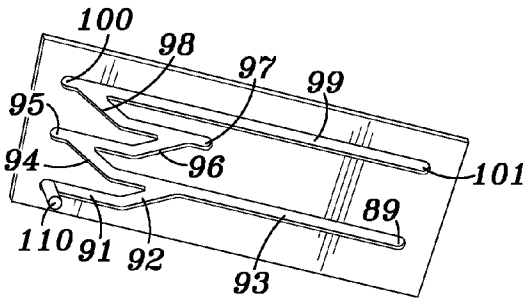
FIG. 12 is a depiction of the grooves located on the outer surface of the lower indexing sleeve.

A lower cylindrical indexing sleeve 103 shown in perspective in FIG. 11 includes an uphole portion 105 and a downhole portion 61. Lower indexing sleeve 103 also include a plurality of grooves 89-101 on its outer surface as depicted in FIG. 12. Lower indexing sleeve is adapted for rotational and axial movement within the injection valve housing. An annular power spring 41 surrounds the lower portion 40 of the upper flow tube 36 and the uphole portion 105 of the lower indexing sleeve as shown in FIG. 8. Power spring 41 is captured between upper flow tube 36 and a shoulder 104 in the interior of middle housing 22 so that as upper flow tube is moved in a downhole direction via piston 26 by pressure within the tubular string, power spring 41 is compressed. Downhole movement of section 61 of the lower indexing sleeve is constrained by a shoulder 64 pivoted in the interior surface of injection valve housing 22. A fixed pin 110 guides movement of lower indexing sleeve 103 via grooves 91-101.

A plurality of locking dogs 35 cooperate with a groove 37 on the interior surface of upper flow tube 36 to lock the variable orifice insert within the injection valve. In the position shown in FIG. 8, lower portion 61 of the lower indexing sleeve holds flapper element 63 in an open position. A locking collet 42 is located at the lower end of lower portion 40 of the upper flow tube and is adapted to capture the lower indexing sleeve at groove 49.

The operation of the variable orifice insert including the run in position is more fully described in U.S. Patent Application Publication number 2015/0361763A1 published Dec. 17, 2015, the entire contents of which is hereby expressly incorporated herein by reference thereto.

Figure 14:
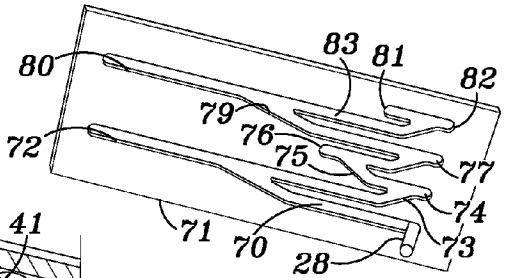
FIG. 14 is a depiction of the position of the pin within the grooves on the surface of the upper indexing sleeve in the position of the injection valve shown in FIG. 1.
Figure 13:
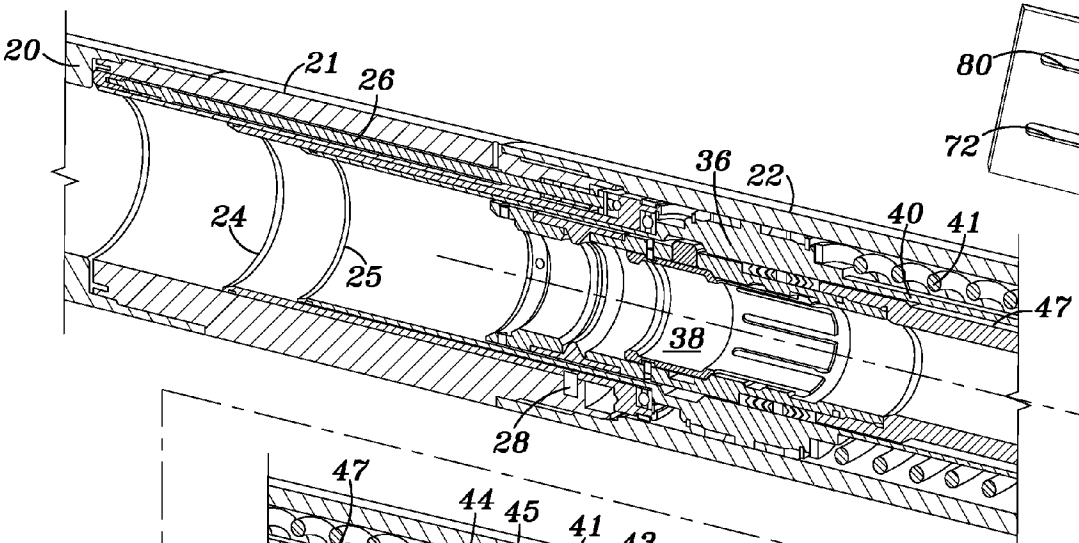
FIG. 13 is a cross-sectional view of the injection valve as it is positioned above the polished bore receptacle as shown in FIG. 1.
Figure 13:
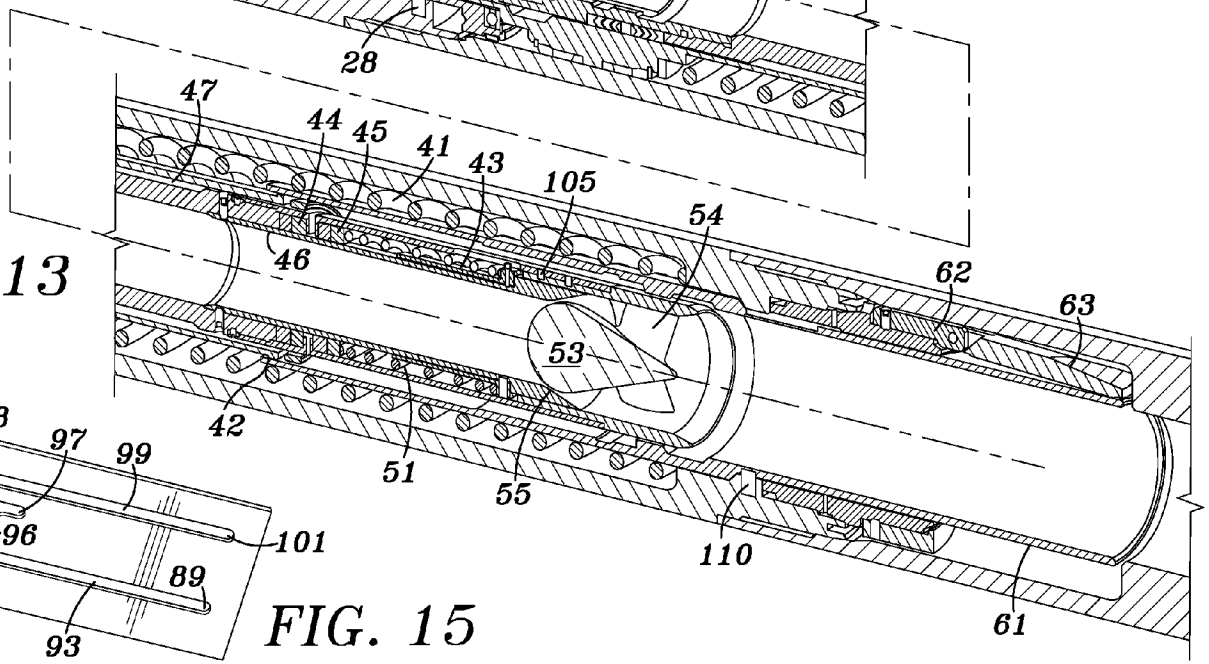
Figure 15:
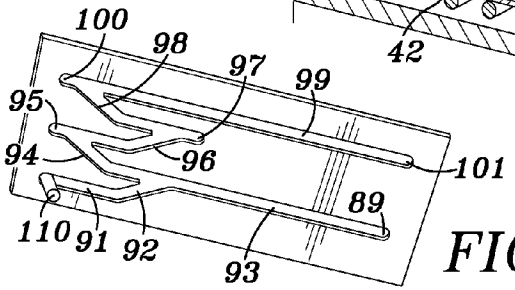
FIG. 15 is a showing of the position of the pin within the grooves of the lower indexing sleeve when the injection valve is in the position shown in FIG. 1.

FIG. 13 illustrates the condition of the injection valve at its location in the well shown in FIG. 1. In this position flapper element 63 is in an open position, the variable orifice insert is in the bypass position, pin 28 of the upper indexing sleeve is within the downhole end of slot 70 as shown in FIG. 14 and pin 110 of the lower indexing sleeve is at the top of groove 91 as shown in FIG. 15.

Figures 16, 17, 18:
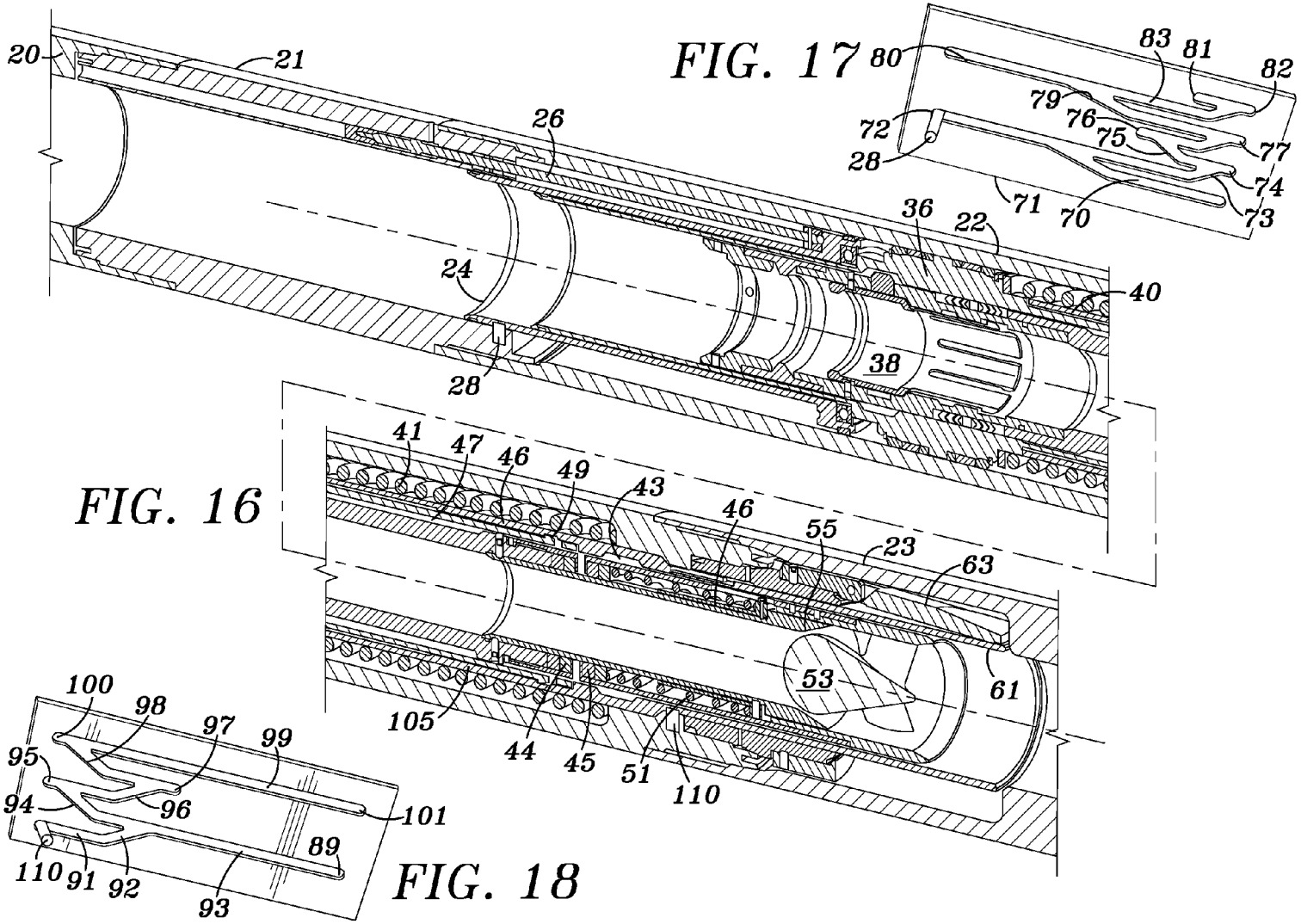
FIG. 16 is a showing of the injection valve in the position shown in FIG. 2 with the stab sealing into the polished bore receptacle.
FIG. 17 is a showing of the position of the pin within the grooves of the upper indexing sleeve when the injection valve is in the condition shown in FIG. 16.
FIG. 18 is a showing of the position of the pin in the grooves of the lower indexing sleeve when the injection valve is in the condition shown in FIG. 16.

FIG. 16 illustrates the condition of the injection valve shown in the position of FIG. 2 after the tubing pressure against the barrier valve been increased. Pressure acting on piston 26 moves the piston in a downhole direction which in turn axially moves upper indexing sleeve 24, upper flow tube 36 and variable orifice insert 13 downwardly, thereby compressing power spring 41. Pin 28 is now located at the top of groove 72 of upper indexing sleeve as depicted in FIG. 17 and pin 110 is positioned at the top of groove 91 of the lower indexing sleeve as shown in FIG. 18. The variable orifice insert is still in the bypass mode allowing limited fluid flow through annular orifice 105. Lower portion 40 of the upper flow tube engages and captures upper portion 105 of the lower indexing sleeve at 49.

Figure 20:
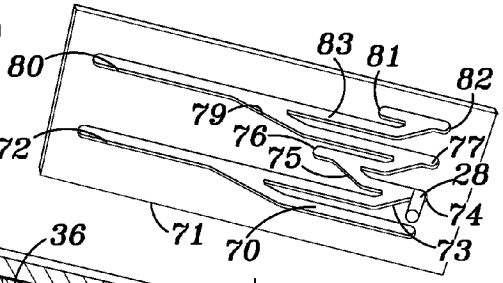
FIG. 20 is a showing of the position of the pin in the grooves of the upper indexing sleeve when the injection valve is in the condition shown in FIG. 19.
Figure 19:
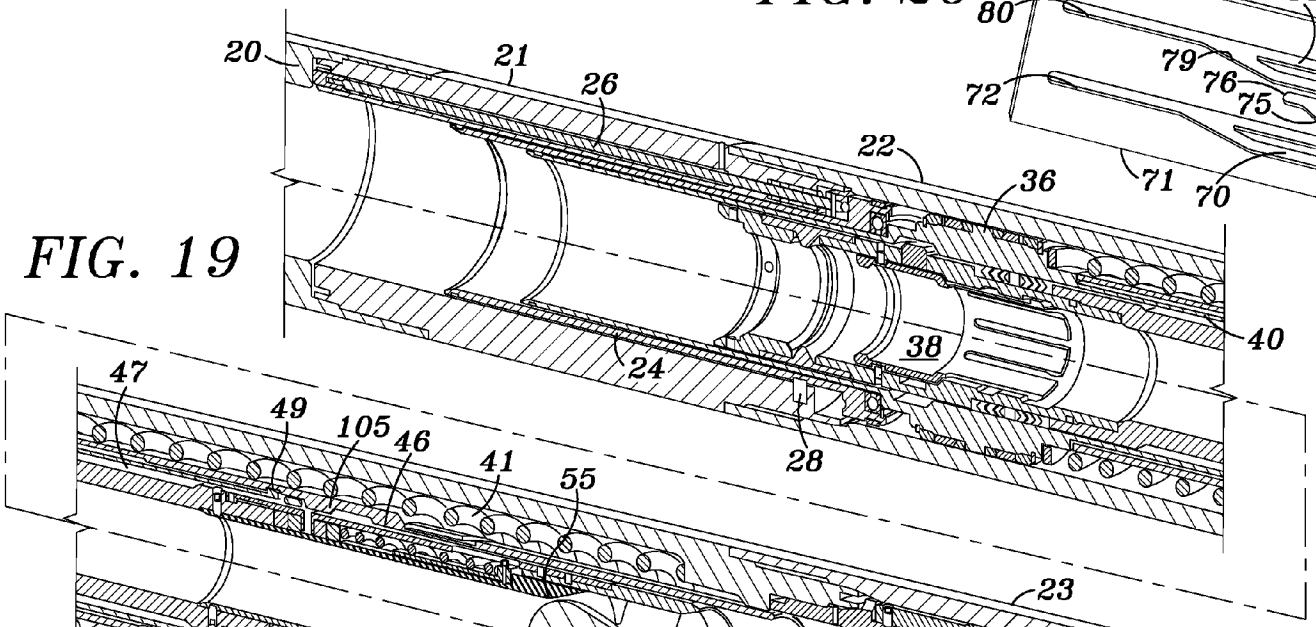
FIG. 19 is a cross-sectional view of the injection valve in the position of FIG. 3 once the tubing pressure has been bled to close the flapper valve.
Figure 21:
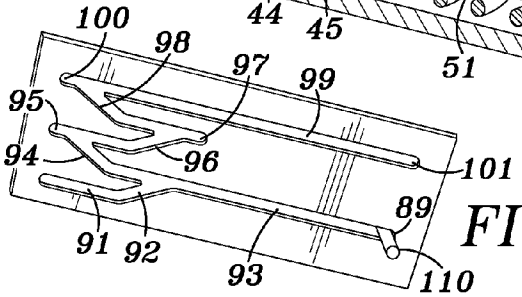
FIG. 21 is a showing of the position of the pin in the grooves of the lower indexing sleeve when the injection valve is in the condition shown in FIG. 19.

FIG. 19 illustrates the condition of the injection valve as shown in FIG. 3 after the tubing pressure is relieved. Power spring 41 shifts upper flow tube 36, lower flow tube 40 and the lower indexing sleeve and variable orifice insert to an uphole portion. This causes flapper element 63 to close. Pin 28 is now positioned at the bottom of groove 74 of the upper indexing sleeve and pin 110 is positioned at 89 of the lower indexing sleeve as shown in FIGS. 20 and 21.

Figures 22, 23, 24:
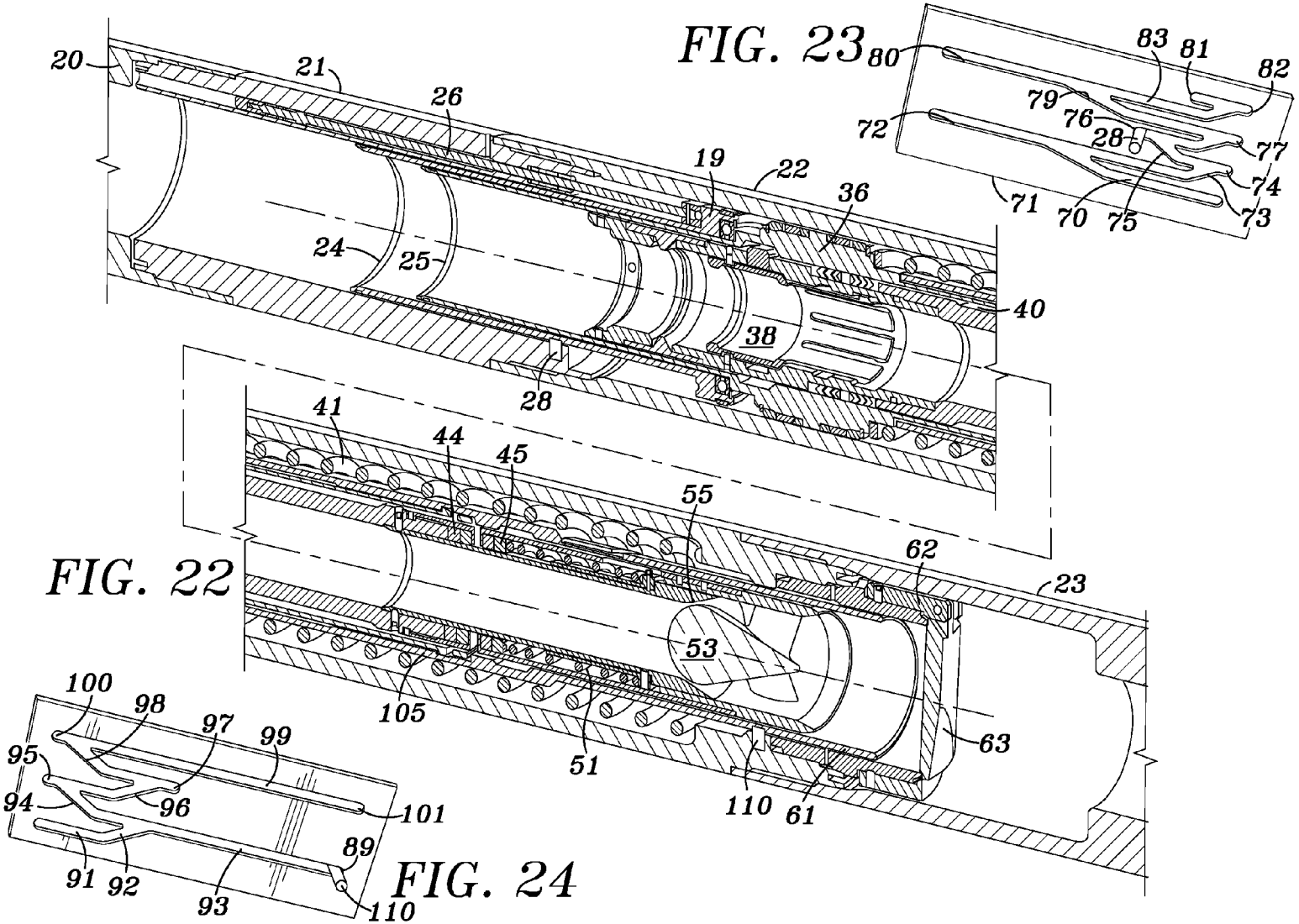
FIG. 22 is a cross-sectional view of the injection valve in the position shown in FIG. 3 with the pressure increased.
FIG. 23 is a showing of the position of the pin in the grooves of the upper indexing sleeve when the injection valve is in the condition shown in FIG. 22.
FIG. 24 is a showing of the position of the pin in the grooves of the lower indexing sleeve when the injection valve is in the condition shown in FIG. 22.

As pressure within the tubing is increased to do pressure testing, the piston 26, upper flow tube 36, upper and lower indexing sleeves well be moved downwardly a short distance as shown in FIG. 22 and as illustrated by the pin 28 being positioned at 76 in the upper indexing sleeve as shown in FIG. 23. Pin 28 thus restricts further downward movement of upper indexing sleeve 24. Pin 110 is located at position 89 shown in FIG. 24. Power spring 41 has been compressed a limited amount. Flapper valve 63 remains closed.

At this point pressure within the tubing is relieved so that the injection valve is now in the position shown in FIG. 25. Pressure can be applied between the injection valve and the barrier valve through pressure downhole gauge 7 for testing purposes. Any leak rate is monitored. In this position flapper element 63 is closed as is barrier valve 6. Pin 28 is positioned at 77 of the upper indexing sleeve as shown in FIG. 26 and pin 110 is located at position 89 of the lower indexing sleeve as shown in FIG. 27. Power spring 41 has moved the piston, upper and lower indexing sleeves, the upper flow tube and the variable orifice insert to the position shown in FIG. 25. If the pressure testing is successful, the blowout preventer at the well head may now be removed.

Figures 28, 29, 30:
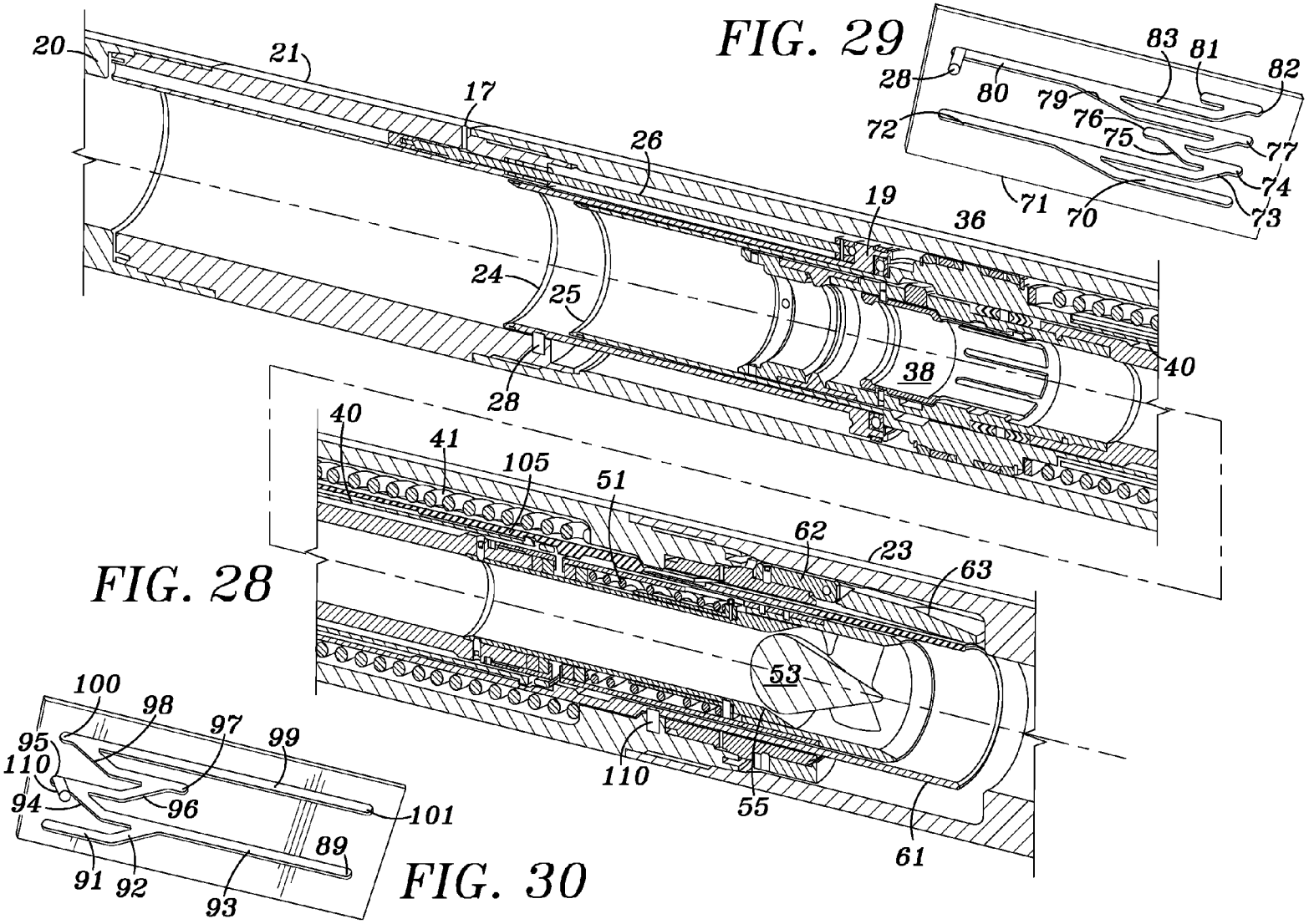
FIG. 28 is a cross-sectional view of the injection valve after pressure testing and with the flapper element in an open position.
FIG. 29 is a showing of the position of the pin in the grooves of the upper indexing sleeve when the injection valve is in the condition of FIG. 28.
FIG. 30 is a showing of the position of the pin in the grooves of the lower indexing sleeve when the valve is in the condition of FIG. 28.

At this point in the well completion process, tubing pressure can be increase and flapper element 63 will be opened as shown in FIG. 28 by virtue of piston 26 moving downhole thereby axially moving upper indexing sleeve 24, flow tube 36 and lower indexing sleeve 103. Lower portion 61 of the lower indexing sleeve 13 will pivot flapper element 63 to an open position.

In this state of operation, pin 28 will be at location 80 of the upper indexing sleeve as shown in FIG. 29 and pin 110 will be at location 95 of the lower indexing sleeve as shown in FIG. 30.

Figures 31, 32, 33:
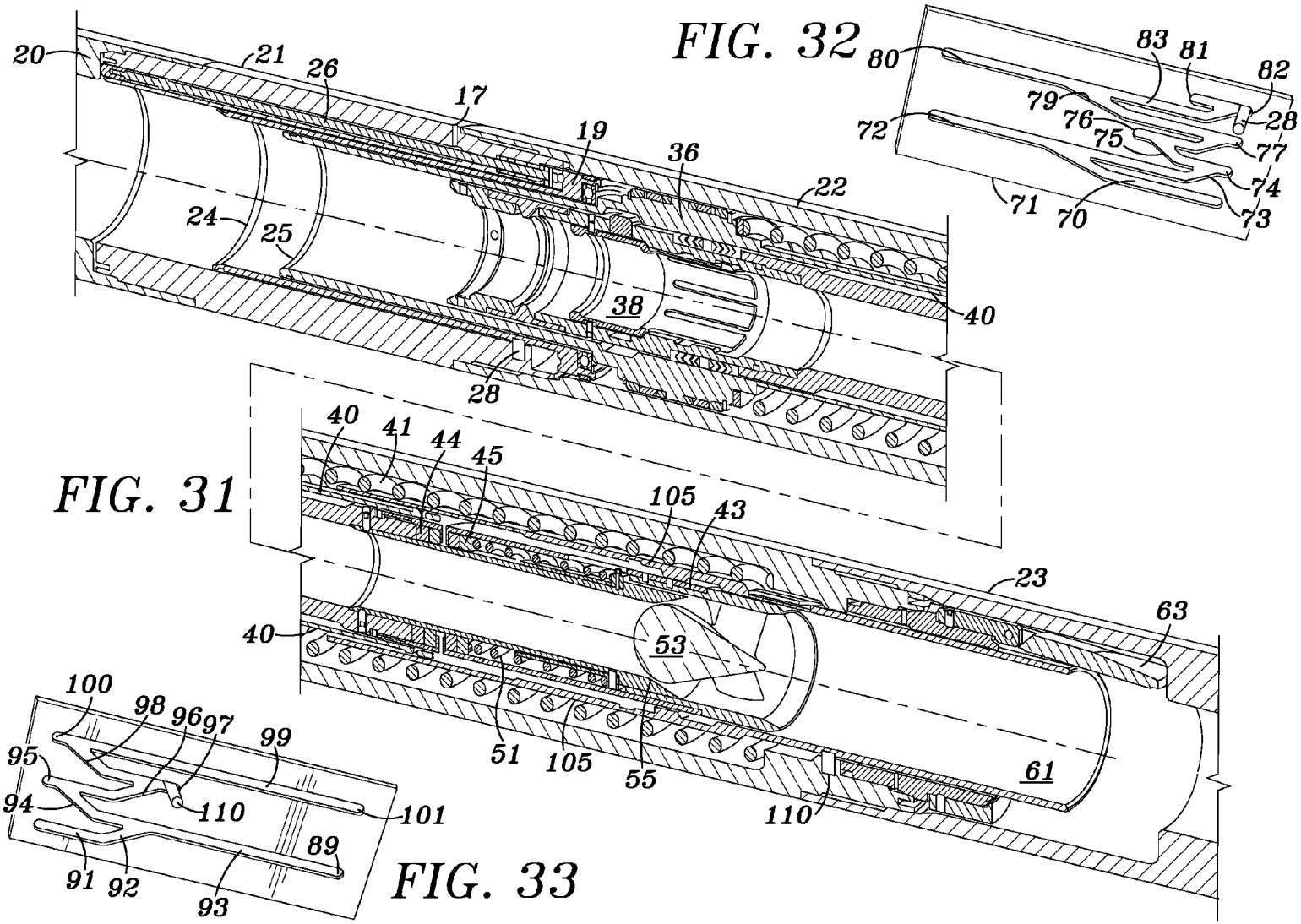
FIG. 31 is a cross-sectional view of the injection valve after the flapper valve has been opened and the tubing pressure bled.
FIG. 32 is a showing of the position of the pin in the grooves of the upper indexing sleeve when the valve is in the condition shown in FIG. 31.
FIG. 33 is a showing of the position of the pin in the grooves of the lower indexing tube when the injection valve is in the condition shown in FIG. 31.

At this point pressure within the tubing can be relieved and the injection valve will revert back to the condition of FIG. 31. Power spring acts on upper flow tube 36, upper indexing sleeve 24 and piston 26 to move them to the position shown in FIG. 31. Pin 28 is positioned at location 82 of the upper indexing sleeve as shown in FIG. 32 and pin 110 of the lower indexing sleeve is at position 97 as shown in FIG. 33.

Figure 35:
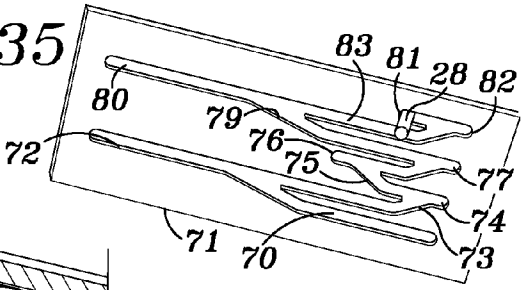
FIG. 35 is a showing of the position of the pin in the grooves of the upper indexing sleeve when the injection valve is in the condition shown in FIG. 34.
Figure 34:
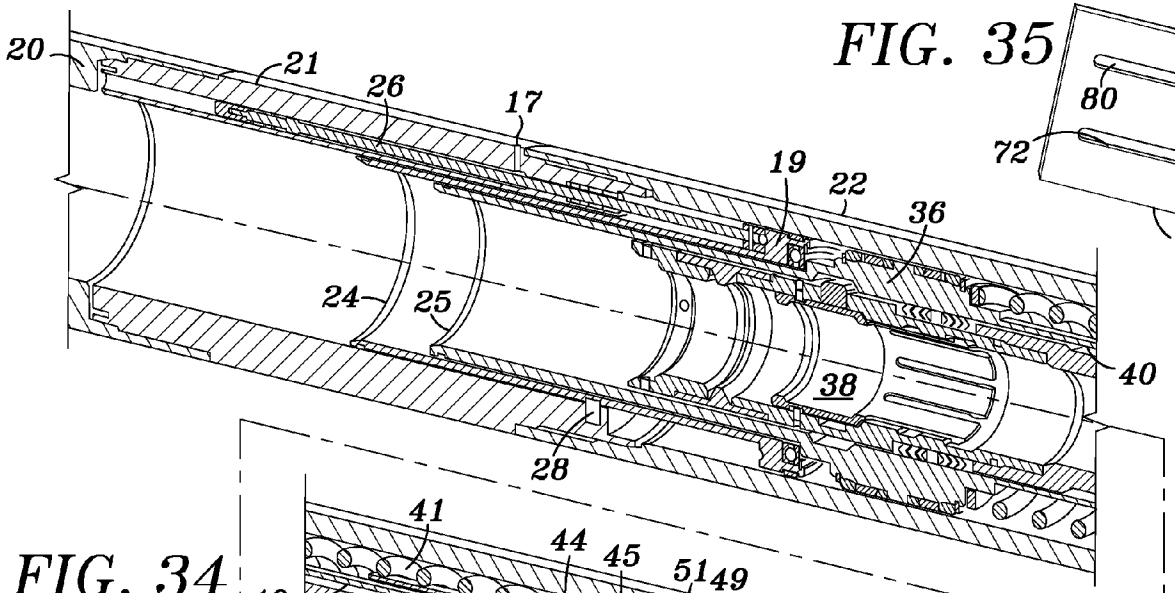
FIG. 34 is a cross-sectional view of the injection valve during the application of pressure cycles as needed to open the barrier valve.
Figure 34:
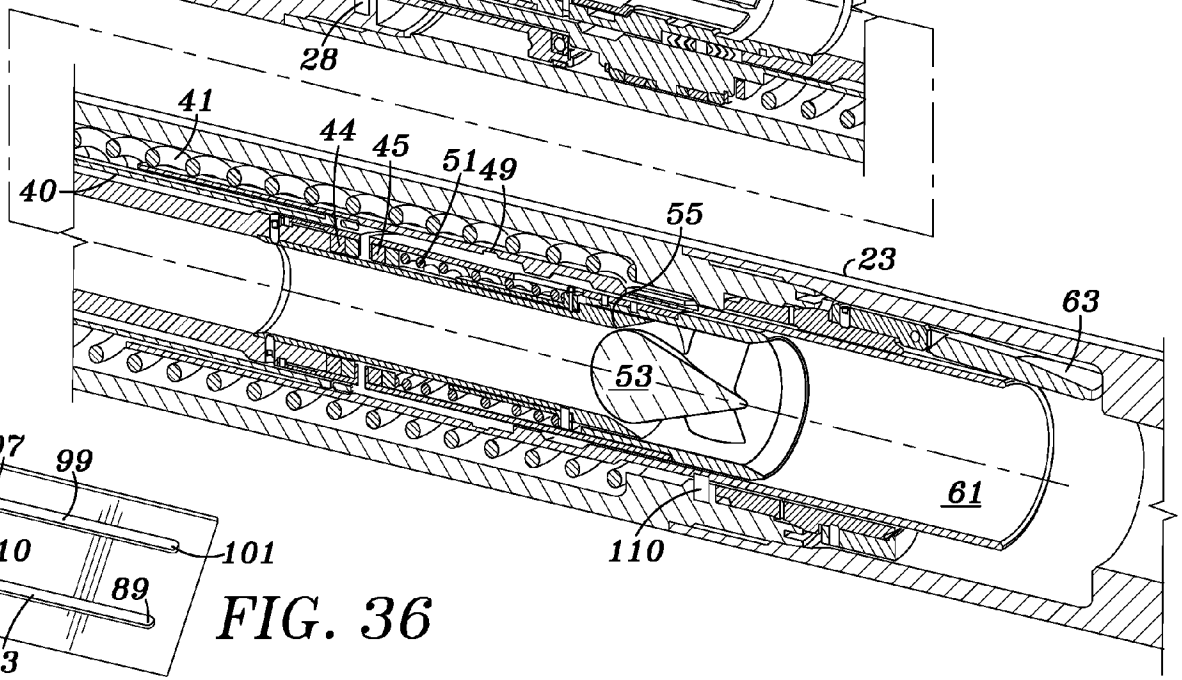
Figure 36:
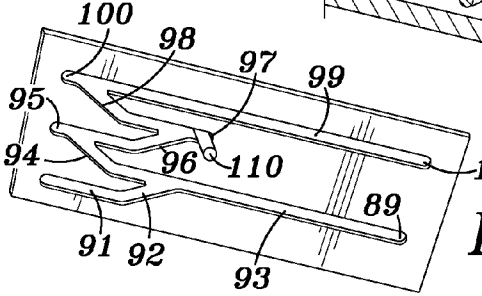
FIG. 36 is a showing of the position of the pin in the grooves of the lower indexing sleeve when the injection valve is in the condition shown in FIG. 34.

As pressure cycles are applied to the injection valve, in the condition of FIG. 31 as required to open the barrier valve, upper indexing sleeve's axial movement is limited by end points 81 and 82 as shown in FIG. 35 which limits the movement of piston 26. Consequently flapper element 63 remains in an open position as shown in FIG. 34. Pin 110 is located at position 97 of the lower indexing sleeve as shown in FIG. 36.

Figure 38:
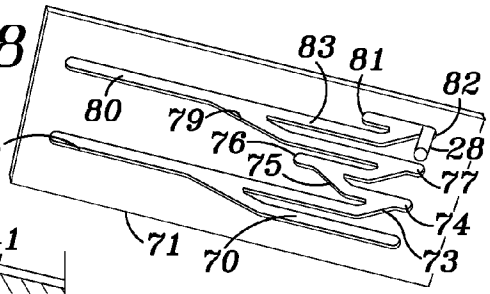
FIG. 38 is a showing of the position of the pin in the grooves of the upper indexing sleeve when the injection valve is in the condition shown in FIG. 37.
Figure 37:
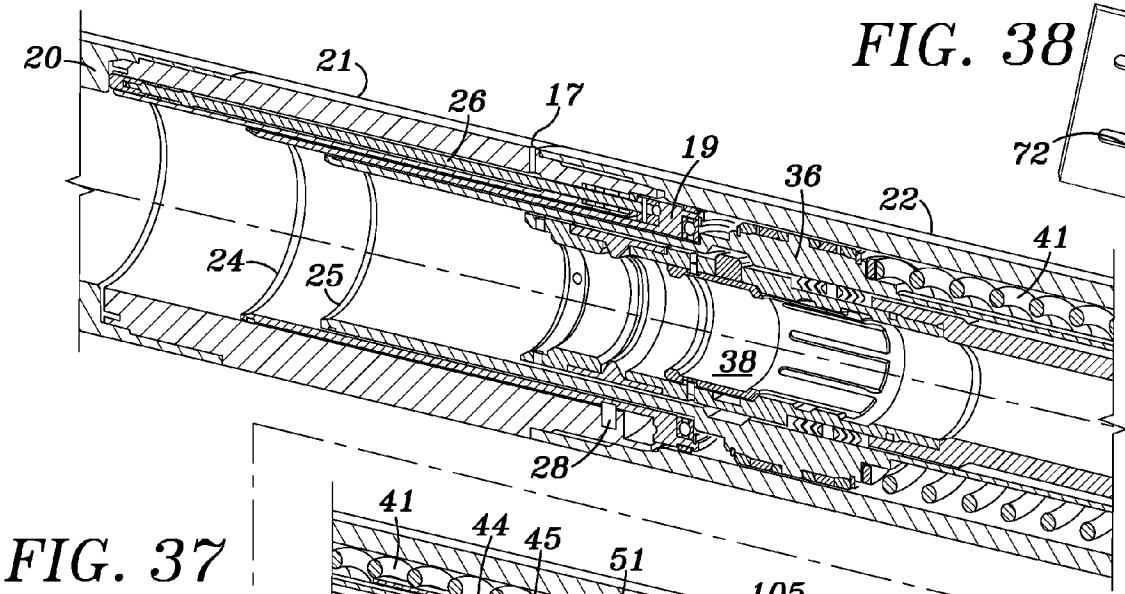
FIG. 37 is a cross-sectional view of the injection valve with the flapper element in an open position.
Figure 37:
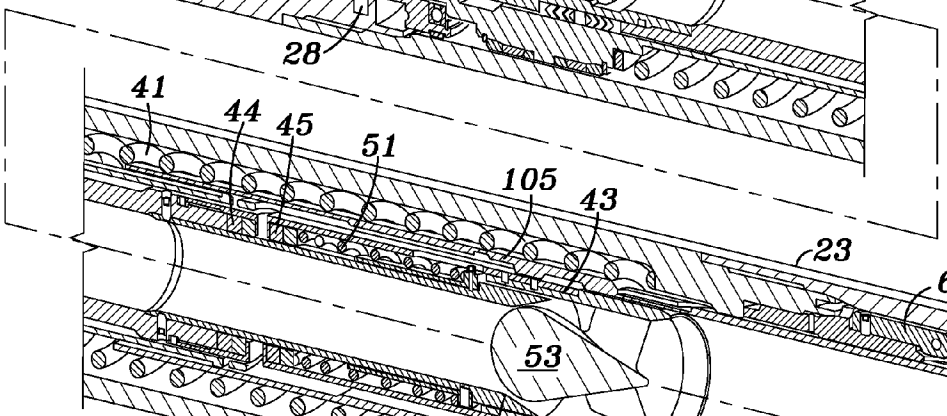
Figure 39:
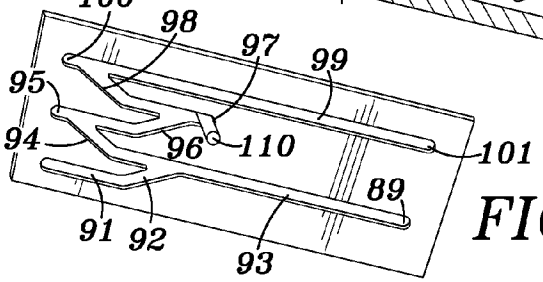
FIG. 39 is a showing of the position of the pin the grooves of the lower indexing sleeve when the injection valve is in the condition shown in FIG. 37.

When the barrier valves is opened and flow occurs, piston 28, upper indexing sleeve 24 and upper flow tube 36 will be returned to position shown in FIG. 37. Pin 28 is at position 82 of the upper indexing sleeve as shown in FIG. 38 and pin 110 remains at position 97 of the lower indexing sleeve as shown in FIG. 39.

Figures 40, 41, 42:
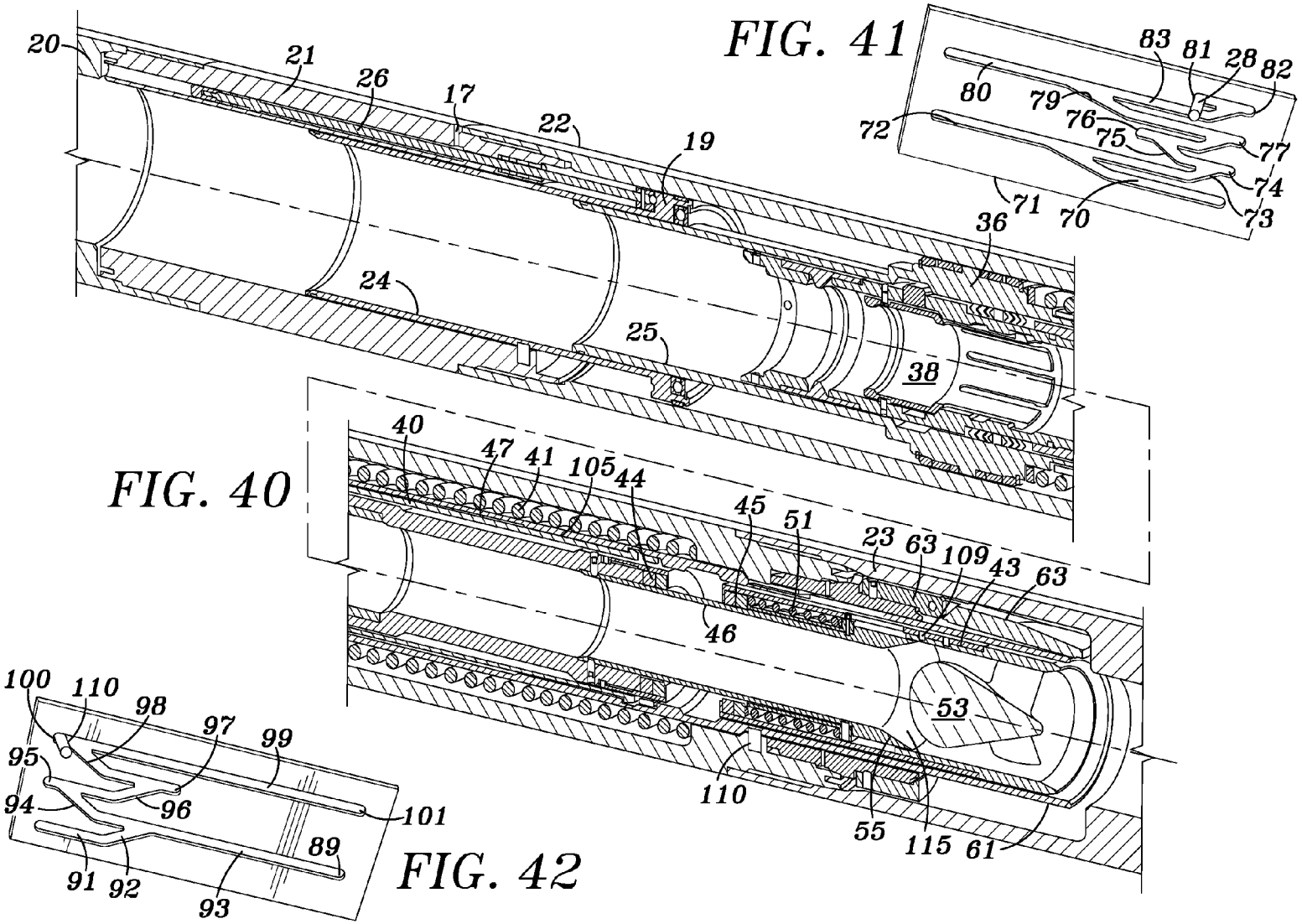
FIG. 40 is a cross-sectional view of the injection valve when the barrier valve is in the open position and there is full flow through the variable orifice insert.
FIG. 41 is a showing of the position of the pin in the grooves of the upper indexing sleeve when the injection valve is in the condition shown in FIG. 40.
FIG. 42 is a showing of the position of the pin in the grooves of the lower indexing sleeve when the injection valve is in the condition shown in FIG. 40.

Full flow is now possible through the injection valve and the barrier as shown in FIG. 40. Flapper element 63 has been moved to a fully open position by lower portion 61 of the lower indexing sleeve and valve body 53 has been axially displaced from valve seat 55 by the full flow thereby creating annular orifice 105. Spring 51 is compressed by axially movement of lower flow sleeve 43. The force of the full flow through the injection valve is sufficient to overcome the attractive force between magnets 44 and 45 and the force necessary to compress spring 51. Power spring 41 is also compressed by the force of injection fluid acting on upper flow tube at 36. Downhole movement of upper indexing sleeve 24 is prohibited by pin 28 engaging the top portion 81 of the groove in the outer surface of upper indexing sleeve 24 as shown in FIG. 41. Lower indexing sleeve has moved in a downhole direction to a point where further movement is blocked by pin 110 engaging the groove on the outer surface of the lower indexing sleeve at 100, as shown in FIG. 42.

Figure 43:
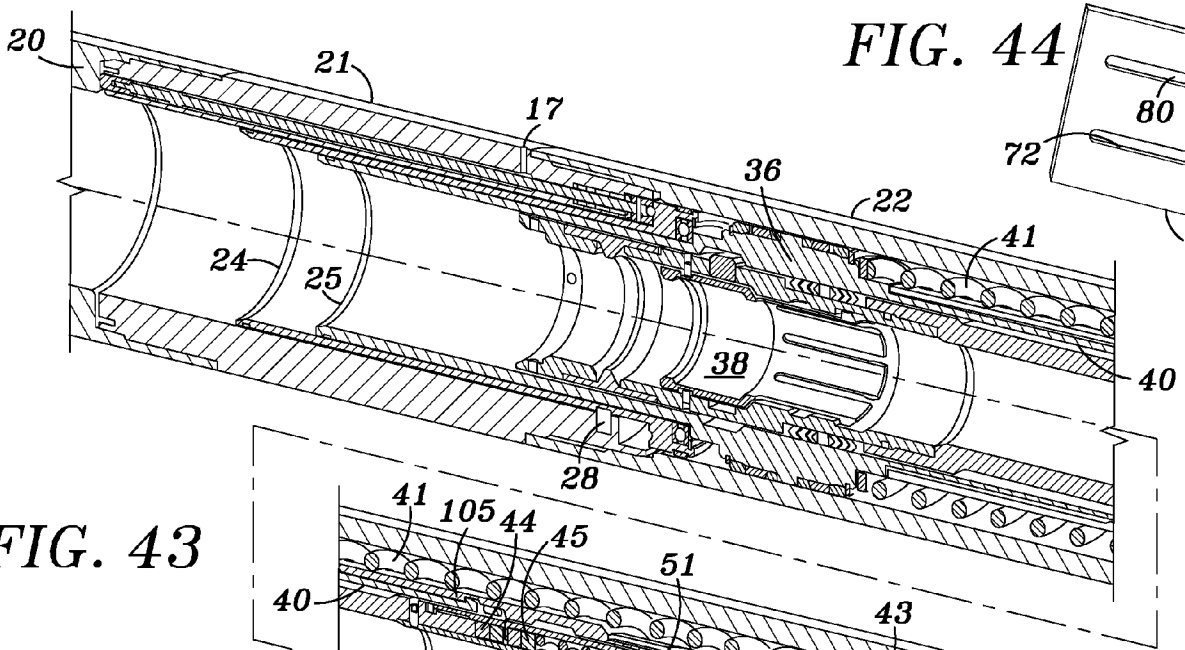
FIG. 43 is a cross-sectional view of the injection valve with injection flow terminated.
Figure 43:
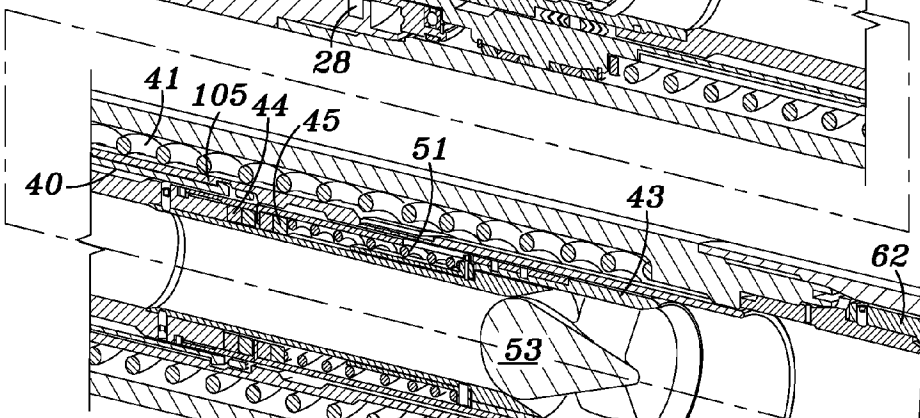

Stopping the flow of injection fluid will result in the injection valve moving to the condition shown in FIG. 43. Power spring 41 shifts upper flow tube 36 in an uphole direction and upper flow tube 36 through locking collet 42 in groove 49 of the lower indexing sleeve carriers with it lower portion 61 of the lower indexing sleeve 103 to the position shown in FIG. 43. Flapper 63 is resiliently biased to a closed position as is well known in the art and thus will pivot to engage valve seat 111 thus preventing uphole fluid flow.

Spring 51 and magnets 44, 45 will move lower flow sleeve 43 and valve body 53 in an uphole direction to engage valve seat 55 thereby forming a second valve which prevents uphole fluid flow. Thus a dual barrier safety valve is formed.

Figure 44:
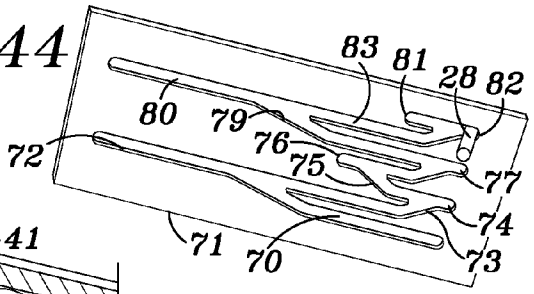
FIG. 44 is a showing of the position of the pin in the grooves of the upper indexing sleeve when the injection fluid is in the condition shown in FIG. 43.
Figure 45:
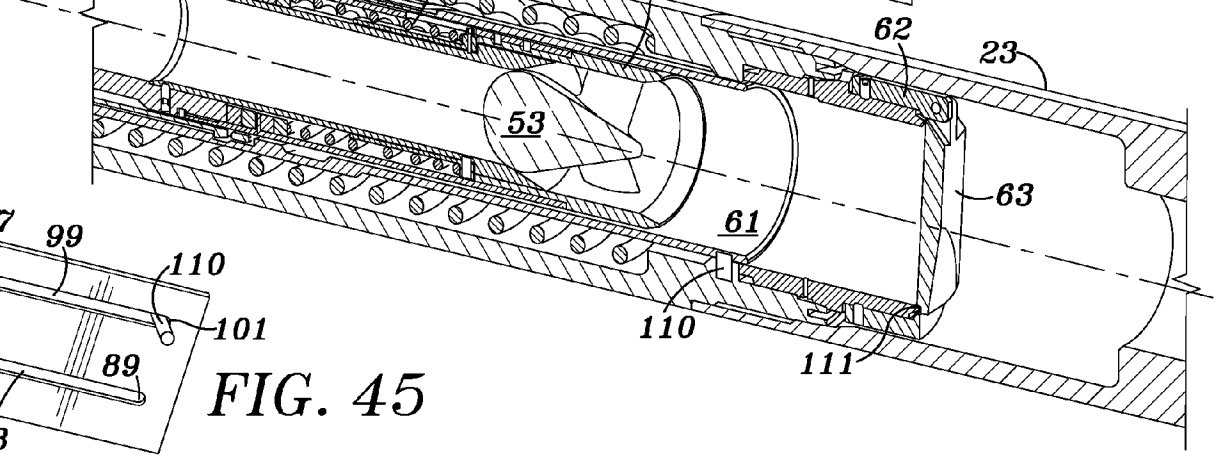
FIG. 45 is a showing of the position of the pin in the lower indexing sleeve when the injection vale is in the condition shown in FIG. 43.
Figure 45:
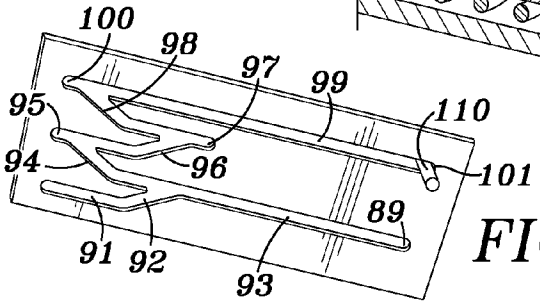

Pin 28 is located at position 82 of the upper indexing sleeve as shown in FIG. 44 and pin 110 is positioned at point 101 in the lower indexing sleeve as shown in FIG. 45.

If injection fluid flow is restarted, the injection valve will assume the full flow condition shown in FIG. 40 with the travel of the upper indexing sleeve limited by the distance between points 81 and 82 as shown in FIG. 41 and lower flow tube can move axially between point 100 and 101 as shown in FIG. 45. In this manner, injection fluid flow may be started and stopped an unlimited number of times. Once the drilling blow out preventer is removed, a production tree is installed on the well. The barrier valve can now be cycled permanently open thereby activating the injection valve. When this occurs, dual barriers are maintained by the injection valve and the production tree.

The spring constants for springs 41 and 51 are chosen such that upper flow tube 36 will move to open the flapper valve at a first pressure level and an increased flow pressure will open the variable annular orifice 115.

Although the present invention and its advantages have been described in detail, it should be understood that various changes, substitutions and alterations may be made herein without departing from the spirit and scope of the invention as defined by the appended claims.

What is claimed is:

1. An injection valve for use in completing an oil and or gas well comprising;

a) a housing, b) an axially movable piston located in a chamber provided in the housing, c) an upper indexing sleeve having a plurality of groove segments on an outer surface of the indexing sleeve, d) an upper flow tube axially movable within the housing, e) a power spring compressed by downhole movement of the upper flow tube, f) a lower indexing sleeve having a plurality of groove segments on an outer surface of the lower indexing sleeve, g) a first valve including a flapper element and a valve seat at a downhole portion of the housing, and h) a variable orifice insert positioned within the housing and including a second valve having a second valve body and second valve seat, the second valve being biased to a closed position.

2. The injection valve of claim 1 further including a first stationary pin fixed in the housing and adapted to engage the segments of the upper indexing sleeve and a second stationary pin fixed in the housing and adapted to engage the segments of the grooves of the lower indexing sleeve.

3. The injection valve of claim 2 wherein the upper and lower indexing sleeve are radially and axially movable within the housing and the amount of radial and axial movement is defined by the pins engaging the groove segments on the outer surfaces of the upper and lower indexing sleeves respectively.

4. An injection valve as claimed in claim 1 wherein the lower indexing sleeve includes a lower portion which is adapted to move the flapper element of the first valve to an open position.

5. An injection valve as claimed in claim 1 wherein the upper flow tube has a lower portion including a locking collet which is adapted to capture an upper portion of the lower indexing sleeve.

6. The injection valve as claimed in claim 1 wherein the second valve of the variable orifice insert is biased to a closed position by a pair of opposite polarity magnets and a spring.

7. The injection vale as claimed in claim 6 wherein the variable orifice insert comprises an upper and a lower flow section, a lower flow sleeve surrounding the lower flow section, one of said magnets being fixed on the lower flow section and one of said magnets being movable with the lower flow sleeve.

8. The injection valve of claim 7 wherein the lower flow sleeve is axially movable and carries the second valve body, and the second vale seat is formed at an end portion of the lower flow section.

9. The injection valve of claim 1 wherein the upper indexing sleeve surrounds an upper portion of the upper flow tube.

* * * * *